US008022841B2

(12) United States Patent
Alon et al.

(10) Patent No.: US 8,022,841 B2
(45) Date of Patent: Sep. 20, 2011

(54) SYSTEM AND METHOD FOR ASCRIPTION OF FOREIGN OBJECT DEBRIS DETECTED ON AIRPORT TRAVEL SURFACES TO FOREIGN OBJECT SOURCES

(75) Inventors: Nitzan Alon, Rosh-Haayin (IL); Meny Benady, Tel-Aviv-Yafo (IL); Oded Hanson, Givatayim (IL); Aviv Goner, Tel Aviv-Yafo (IL); Arik Fux, Rehovot (IL)

(73) Assignee: Xsight Systems Ltd., Rosh Haayin (IL)

( * ) Notice: Subject to any disclaimer, the term of this patent is extended or adjusted under 35 U.S.C. 154(b) by 687 days.

(21) Appl. No.: 12/059,377

(22) Filed: Mar. 31, 2008

(65) Prior Publication Data

US 2009/0243881 A1 Oct. 1, 2009

(51) Int. Cl.
*G08B 21/00* (2006.01)

(52) U.S. Cl. ..... 340/945; 701/120; 340/971

(58) Field of Classification Search ..... 340/945, 340/933, 937, 961, 972, 983, 904, 905, 971; 701/120, 301

See application file for complete search history.

(56) References Cited

U.S. PATENT DOCUMENTS

| | | | | |
|---|---|---|---|---|
| 5,185,815 | A | 2/1993 | Brandstetter | |
| 5,212,547 | A | 5/1993 | Otsuki et al. | |
| 5,243,340 | A | 9/1993 | Norman et al. | |
| 5,375,058 | A | 12/1994 | Bass | |
| 5,629,691 | A | 5/1997 | Jain | |
| 5,939,987 | A | 8/1999 | Cram | |
| 6,064,429 | A | 5/2000 | Belk et al. | |
| 6,181,261 | B1 * | 1/2001 | Miles et al. | 340/971 |
| 6,281,806 | B1 | 8/2001 | Smith et al. | |
| 6,295,007 | B1 | 9/2001 | O'Meara | |
| 6,486,825 | B1 | 11/2002 | Smithey | |
| 6,563,432 | B1 | 5/2003 | Millgård et al. | |

(Continued)

FOREIGN PATENT DOCUMENTS

DE 10104950 10/2001

(Continued)

OTHER PUBLICATIONS

An International Preliminary Report on Patentability dated Oct. 14, 2010, issued during the prosecution of Applicant's PCT/IL09/000332.

(Continued)

*Primary Examiner* — George Bugg
*Assistant Examiner* — Edny Labbees
(74) *Attorney, Agent, or Firm* — Fish & Richardson P.C.

(57) ABSTRACT

A system for detection of foreign objects on an aircraft travel surface and ascription of the foreign objects present on the aircraft travel surface to foreign object sources, the system including a foreign object detection subsystem operative to detect foreign objects on an aircraft travel surface, a potential foreign object source identifier subsystem operative to indicate the presence of potential foreign object sources at or near the aircraft travel surface and a foreign object to foreign object source correlator operative to receive inputs from the foreign object detection subsystem and from the foreign object source identifier subsystem indicating at least a time relationship between sensed presence of the potential foreign object sources on the aircraft travel surface and detection of the foreign objects and to provide an ascription output indicating the origin of at least some of the foreign objects detected by the foreign object detection subsystem.

20 Claims, 12 Drawing Sheets

U.S. PATENT DOCUMENTS

| | | | | |
|---|---|---|---|---|
| 6,606,035 | B2 * | 8/2003 | Kapadia et al. | 340/972 |
| 6,690,295 | B1 | 2/2004 | De Boer et al. | |
| 6,917,309 | B2 | 7/2005 | Nitzan et al. | |
| 6,956,493 | B1 | 10/2005 | Youngblood | |
| 7,148,815 | B2 | 12/2006 | Derringer | |
| 7,253,748 | B2 | 8/2007 | Nitzan et al. | |
| 2002/0030609 | A1 | 3/2002 | Baumgartner et al. | |
| 2002/0080046 | A1 * | 6/2002 | Derringer | 340/945 |
| 2002/0093433 | A1 | 7/2002 | Kapadia et al. | |
| 2002/0093983 | A1 | 7/2002 | Newberg et al. | |
| 2002/0109625 | A1 * | 8/2002 | Gouvary | 342/29 |
| 2002/0163461 | A1 * | 11/2002 | Smithey | 342/29 |
| 2002/0176603 | A1 | 11/2002 | Bauer et al. | |
| 2007/0296611 | A1 | 12/2007 | Nitzan et al. | |

FOREIGN PATENT DOCUMENTS

| | | |
|---|---|---|
| EP | 0613111 | 8/1994 |
| EP | 1170715 | 1/2002 |
| WO | 02/056054 | 7/2002 |

OTHER PUBLICATIONS

An International Search Report dated Aug. 6, 2009, issued during the prosecution of Applicant's PCTIL09/000332.

An office action dated Oct. 15, 2010, issued during the prosecution of applicant's U.S. Appl. No. 12/686,887.

* cited by examiner

SYSTEM AND METHOD FOR ASCRIPTION OF FOREIGN OBJECT DEBRIS DETECTED ON AIRPORT TRAVEL SURFACES TO FOREIGN OBJECT SOURCES

REFERENCE TO RELATED APPLICATIONS

Reference is made to copending U.S. patent application Ser. No. 11/823,835, filed Jun. 28, 2007, the disclosure of which is hereby incorporated by reference.

Reference is made to U.S. Pat. Nos. 6,917,309 and 7,253,748, the disclosures of which are hereby incorporated by reference.

FIELD OF THE INVENTION

The present invention relates to detection of foreign objects on an aircraft travel surface generally.

BACKGROUND OF THE INVENTION

The following patent documents are believed to represent the current state of the art:

U.S. Pat. Nos. 5,185,815; 5,212,547; 5,243,340; 5,375,058; 5,629,691; 5,939,987; 6,064,429; 6,181,261; 6,281,806; 6,295,007; 6,486,825; 6,563,432; 6,606,035; 6,690,295 and 6,956,493;

U.S. Published Patent Application Nos. 2002/0030609; 2002/0080046; 2002/0093433; 2002/0109625 and 2002/0163461;

German Patent No. DE 101 04 950;

European Patent No. EP 1 170 715; and

Published PCT Patent Application No. WO 02/056054.

SUMMARY OF THE INVENTION

The present invention seeks to provide a system and method for detection of foreign objects on an aircraft travel surface and ascription of the foreign objects to foreign object sources present on the aircraft travel surface.

There is thus provided in accordance with a preferred embodiment of the present invention a system for detection of foreign objects on an aircraft travel surface and ascription of the foreign objects present on the aircraft travel surface to foreign object sources, the system including a foreign object detection subsystem operative to detect foreign objects on an aircraft travel surface, a potential foreign object source identifier subsystem operative to indicate the presence of potential foreign object sources at or near the aircraft travel surface and a foreign object to foreign object source correlator operative to receive inputs from the foreign object detection subsystem and from the foreign object source identifier subsystem indicating at least a time relationship between sensed presence of the potential foreign object sources on the aircraft travel surface and detection of the foreign objects and to provide an ascription output indicating the origin of at least some of the foreign objects detected by the foreign object detection subsystem.

Preferably, the foreign object to foreign object source correlator is operative to provide the ascription output indicating the origin of a foreign object detected by the foreign object detection subsystem within one minute of detection of the foreign object by the foreign object detection subsystem. Additionally or alternatively, the foreign object to foreign object source correlator is operative to provide the ascription output indicating the origin of a foreign object, detected by the foreign object detection subsystem, within one minute of presence of the foreign object.

Preferably, the potential foreign object source identifier subsystem includes an optical identification system. Additionally or alternatively, the potential foreign object source identifier subsystem includes a cooperative sensing subsystem for receiving identification data from potential foreign object sources. In another preferred embodiment, the potential foreign object source identifier subsystem includes ADS-B/Multilateration functionality for receiving identification data from potential foreign object sources.

Preferably, the potential foreign object source identifier subsystem includes a flight database. Additionally or alternatively, the potential foreign object source identifier subsystem includes radar functionality for detecting potential foreign object sources. In another preferred embodiment, the potential foreign object source identifier subsystem includes an integrated system employing multiple identification functionalities.

Preferably, the foreign object to foreign object source correlator is operative to receive inputs from the foreign object detection subsystem and from the foreign object source identifier subsystem indicating a time relationship between sensed presence of the potential foreign object sources on the aircraft travel surface and detection of the foreign objects and to provide, based on the time relationship, the ascription output indicating the origin of at least some of the foreign objects detected by the foreign object detection subsystem.

Preferably, the foreign object to foreign object source correlator is operative in real time. Preferably, the foreign object detection subsystem and the potential foreign object source identifier subsystem are directed to at least partially different regions of the aircraft travel surface.

Preferably, the foreign object detection subsystem includes foreign object material identification functionality including remote spectrometry functionality. Additionally or alternatively, the system also includes decision functionality operative to automatically provide a notification to the origin of the at least some of the foreign objects based on the ascription output. Additionally or alternatively, the system also includes a foreign object source identifier database for storing the ascription output.

There is also provided in accordance with another preferred embodiment of the present invention a method for detection of foreign objects on an aircraft travel surface and ascription of the foreign objects to foreign object sources, the method including detecting foreign objects on an aircraft travel surface, indicating the presence of potential foreign object sources at or near the aircraft travel surface at given times and receiving inputs indicating a time relationship between sensed presence of the potential foreign object sources on the aircraft travel surface and detection of the foreign objects and providing an ascription output indicating the origin of at least some of the foreign objects.

Preferably, the ascription output indicating the origin of a foreign object is provided within one minute of detection of the foreign object on the aircraft travel surface. Additionally, the ascription output indicating the origin of a foreign object is provided within one minute of presence of the foreign object on the aircraft travel surface.

Preferably, the method also includes automatically providing a notification to the origin of the at least some of the foreign objects based on the ascription output. Additionally or alternatively, the method also includes storing the ascription output in a foreign object source identifier database.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENT

Figure 1:
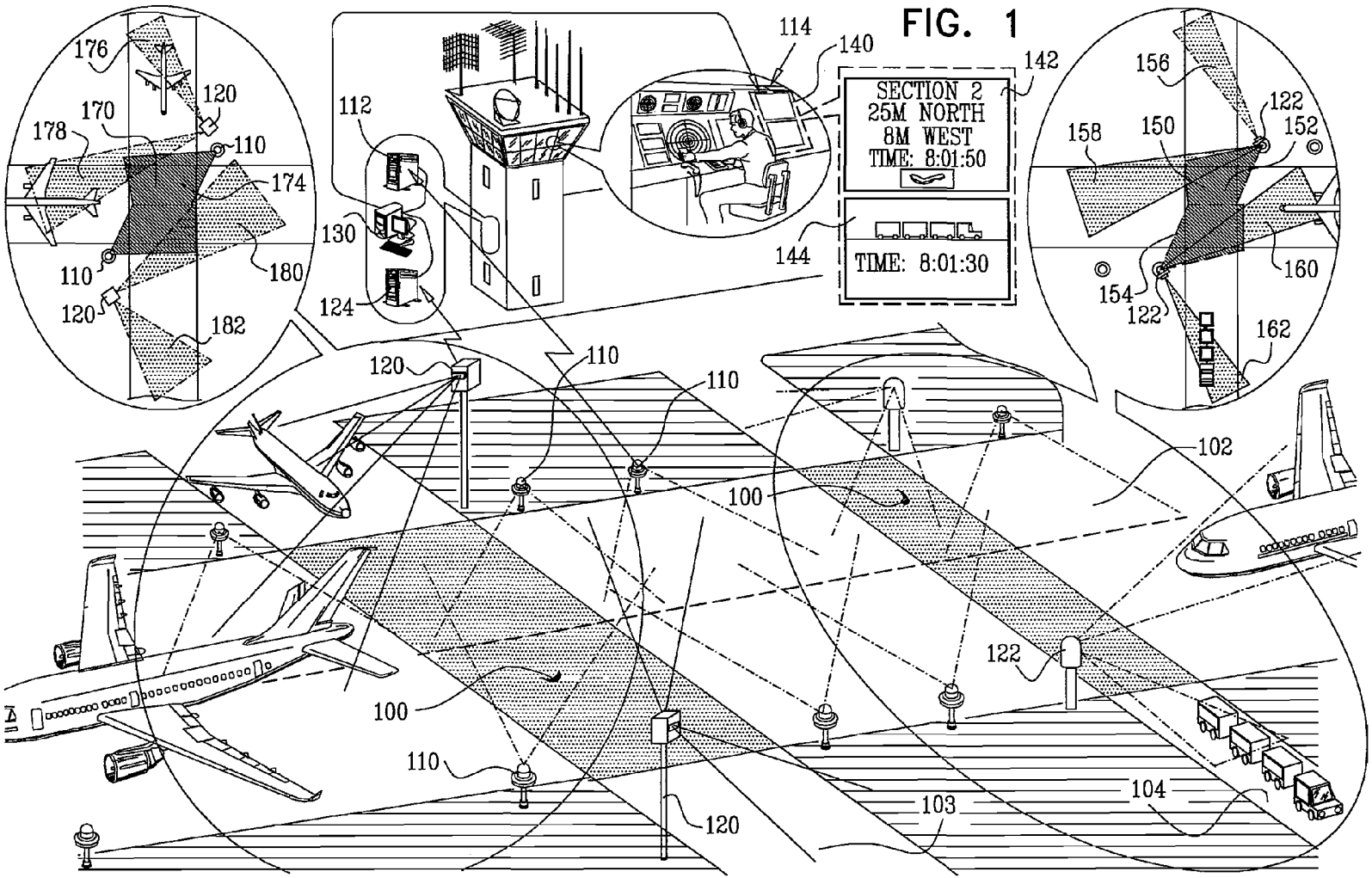
FIG. 1 is a simplified pictorial illustration of a system for detection of foreign objects on an aircraft travel surface and ascription of the foreign objects to foreign object sources present on the aircraft travel surface, constructed and operative in accordance with a preferred embodiment of the present invention.
Figure 2A:
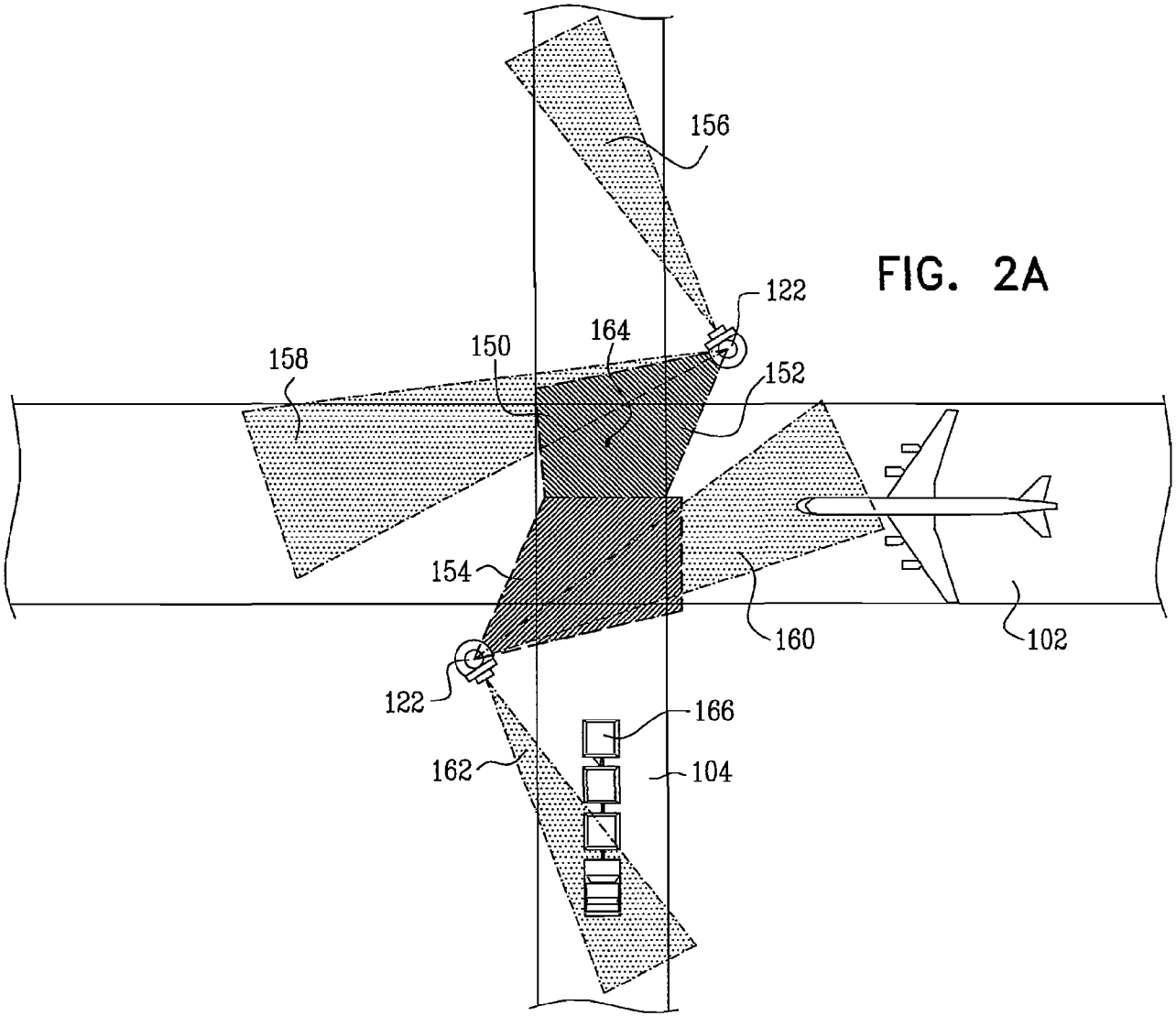
FIGS. 2A and 2B are enlarged simplified pictorial illustrations of portions of FIG. 1.
Figure 2B:
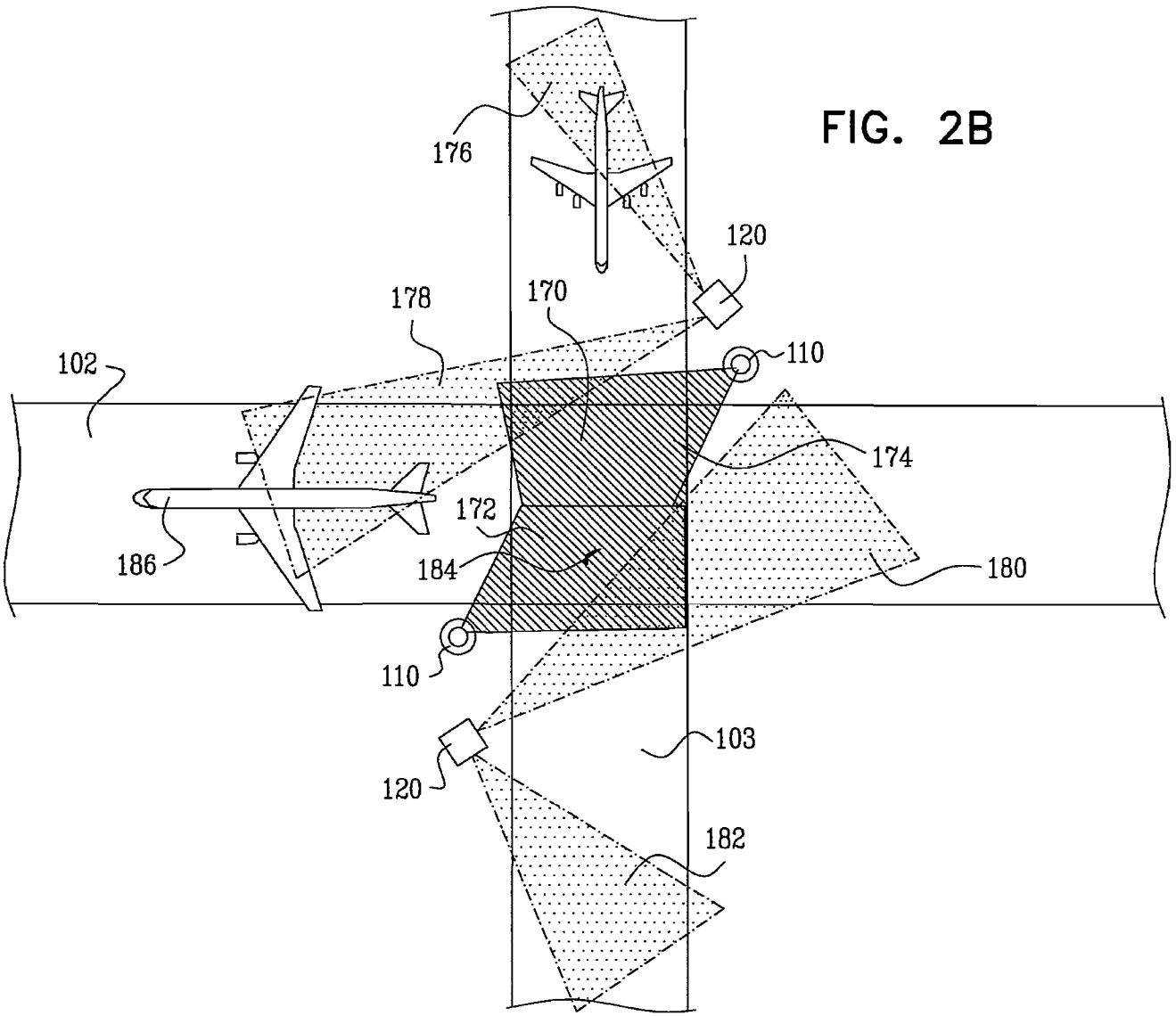

Reference is now made to FIG. 1, which is a simplified pictorial illustration of a system for detection of foreign objects 100, such as parts of aircraft or ground vehicles, wildlife, tools, parts of baggage, chunks of ice and loose pieces of pavement, also known as FOD, on aircraft travel surfaces, such as runways 102, taxiways 103 and ground vehicle service roads 104 and ascription of the foreign objects 100 to foreign object sources, such as aircraft, ground vehicles, wildlife and weather and to FIGS. 2A & 2B, which are enlarged simplified pictorial illustrations of portions of FIG. 1. It is appreciated that aircraft travel surfaces include runways and taxiways, as shown in the illustrated embodiment, as well as other aircraft travel surfaces, including, inter alia, ramps and, aprons.

As seen in FIG. 1, the system includes a foreign object detection subsystem operative to detect foreign objects 100 on an aircraft travel surface such as runways 102, taxiways 103 and ground vehicle service roads 104. The foreign object detection subsystem preferably includes a plurality of FOD detectors. FOD detectors may be any suitable FOD detectors and preferably are FOD detectors 110, located alongside aircraft travel surfaces. A preferred FOD detector forms part of a FOD detection system commercially available from Xsight Systems Ltd. of Rosh Ha'Ayin, Israel under the trademark FODetect. Any other suitable FOD detectors may be employed, such as those employed in the Tarsier system, commercially available from QinetiQ Ltd. of the U.K.

FOD detectors 110 preferably communicate with a server 112 which may be located in propinquity to an airport control center 114. Additionally, in accordance with a preferred embodiment of the invention, FOD identification functionality may be added to the FOD detectors, such as functionality which identifies the material which constitutes the FOD. Remote spectrometry functionality, such as that used in mineral prospecting satellites, may be employed for this purpose. An example of such a product is "FIRST" a hyperspectral-imaging sensor used for standoff chemical identification and mineral and surface studies, which is commercially available from Telops of Quebec, Canada.

In accordance with a preferred embodiment of the present invention, the system also includes a potential foreign object source identifier subsystem operative to indicate the presence of potential foreign object sources at or near aircraft travel surfaces. The potential foreign object source identifier subsystem preferably includes potential foreign object source detectors 120 such as a tower-mounted millimeter wave sensor (MWS) detector, commercially available from Transtech Control Ltd. of Herzlia, Israel.

Additionally or alternatively, the potential foreign object source identifier subsystem may employ combined foreign object and potential foreign object source detectors 122, which may comprise the functionality of FOD detectors 110 combined with ground radar and/or one or more optical or electro-optical sensors. The potential foreign object source detectors employed in detectors 122 may be, for example Airport Surface Detection Equipment Model X (ASDE-X) commercially available from Sensis Corporation of E. Syracuse, N.Y., USA or OIS Optical Identification Sensors, commercially available from Transtech Control Ltd. of Herzlia, Israel. The potential foreign object source identifier subsystem preferably also includes a server 124, which communicates with one or more of detectors 120 and/or 122.

In accordance with a preferred embodiment of the present invention, the system includes a foreign object to foreign object source correlator 130, typically embodied in a suitably programmed computer, which is operative to receive inputs from the foreign object detection subsystem, preferably via server 112, and from the foreign object source identifier subsystem, preferably via server 124. Foreign object to foreign object source correlator 130 is preferably operative to indicate at least a time relationship between sensed presence of potential foreign object sources, such as aircraft, ground vehicles, wildlife and weather, and detection of foreign objects, such as parts of aircraft or ground vehicles, wildlife, tools, parts of baggage, chunks of ice and loose pieces of pavement, on an aircraft travel surface, such as a runway 102 or taxiway 103. Correlator 130 preferably provides an ascription output indicating the origin of at least some of the foreign objects detected by the foreign object detection subsystem.

The ascription output may be presented to an airport official in an airport control center 114 on a display console 140 which may show on a first portion 142 of a screen, an image of the detected FOD and its location, both preferably in a zoomable format, along with a time stamp, and on a second portion 144 of the screen, an image or other representation of a most probable source of the detected FOD, preferably in a zoomable format, along with its time stamp. Based on this information, the airport official may take appropriate action, such as any one or more of the following typical action options:

1. Immediately notify an aircraft, identified as a possible source of detected FOD, and all other relevant parties that a specific part may have fallen from the aircraft;

2. Notify the operator of a ground vehicle, identified as a possible source of detected FOD, and all other relevant parties that a specific part may have fallen from the vehicle;

3. Actuate bird repelling functionality, to remove birds from the vicinity of the aircraft travel surface;

4. Immediate closing of the aircraft travel surface to aircraft movement and removal of the detected FOD;

5. Await a lapse in aircraft travel surface traffic to remove the detected FOD;

6. Await scheduled closure of the aircraft travel surface to remove the detected FOD; and 7. Take no action.

Additionally or alternatively, the ascription output may be employed by automatic recommendation or decision functionality which automatically provides notification to an aircraft, identified as a possible source of detected FOD, and to all other relevant parties that a specific part may have fallen from the aircraft or to the operator of a ground vehicle, identified as a possible source of detected FOD, and to all other relevant parties that a specific part may have fallen from the vehicle. Such functionality could also recommend that the airport official take any one or more suitable action options, examples of which are listed above.

Reference is made additionally to FIGS. 2A and 2B, which illustrate examples of various arrangements of detectors 110, 120 and 122. FIG. 2A shows an intersection 150 between a runway 102 and a ground vehicle service road 104. A pair of combined foreign object and potential foreign object source detectors 122, which may comprise the functionality of FOD detectors 110 combined with ground radar and/or a video camera, are seen positioned adjacent intersection 150. The fields of view 152 and 154 of FOD detection functionality of respective detectors 122 are seen to generally cover most of the area of intersection 150. The fields of view 156 and 158, 160 and 162 of potential foreign object source functionality of respective detectors 122 are seen to generally cover approaches in opposite directions to intersection 150 both along runway 102 and ground vehicle service road 104.

In the illustrated example FOD identified by reference numeral 164 is within the field of view 152 of one of detectors 122 and a ground vehicle, here a baggage train, identified by reference numeral 166, within the field of view 162 of another one of detectors 122.

As seen schematically in FIG. 2A, the relationship between the time stamps of the detection of FOD 164 and of baggage train 166 provide the basis for a conclusion that the FOD 164 fell from the baggage train 166. Such a conclusion would normally be supported by time stamps indicating that the FOD 164 was not present at intersection 150 prior to detection of the baggage train 166, for example within fields of view 156, 158 and 160.

FIG. 2B shows an intersection 170 between a runway 102 and a taxiway 103. A pair of potential foreign object source detectors 120 and a pair of FOD detectors 110 are seen positioned adjacent intersection 170. The fields of view 172 and 174 of FOD detectors 110 are seen to generally cover most of the area of intersection 170. The fields of view 176 and 178, 180 and 182 of potential foreign object source detectors 120 are seen to generally cover approaches in opposite directions to intersection 170 both along runway 102 and taxiway 103.

In the illustrated example, FOD identified by reference numeral 184 is within the field of view 172 of one of detectors 110 and an airplane about to take off, here identified by reference numeral 186, is within the field of view 178 of another one of detectors 120.

As seen schematically in FIG. 2B, the relationship between the time stamps of the detection of FOD 184 and of airplane 186 provide the basis for a conclusion that the FOD 184 fell from airplane 186. Such a conclusion would normally be supported by time stamps indicating that the FOD 184 was not present at intersection 170 prior to detection of the airplane 186, for example within fields of view 176, 178, 180 and 182.

Figure 3A:
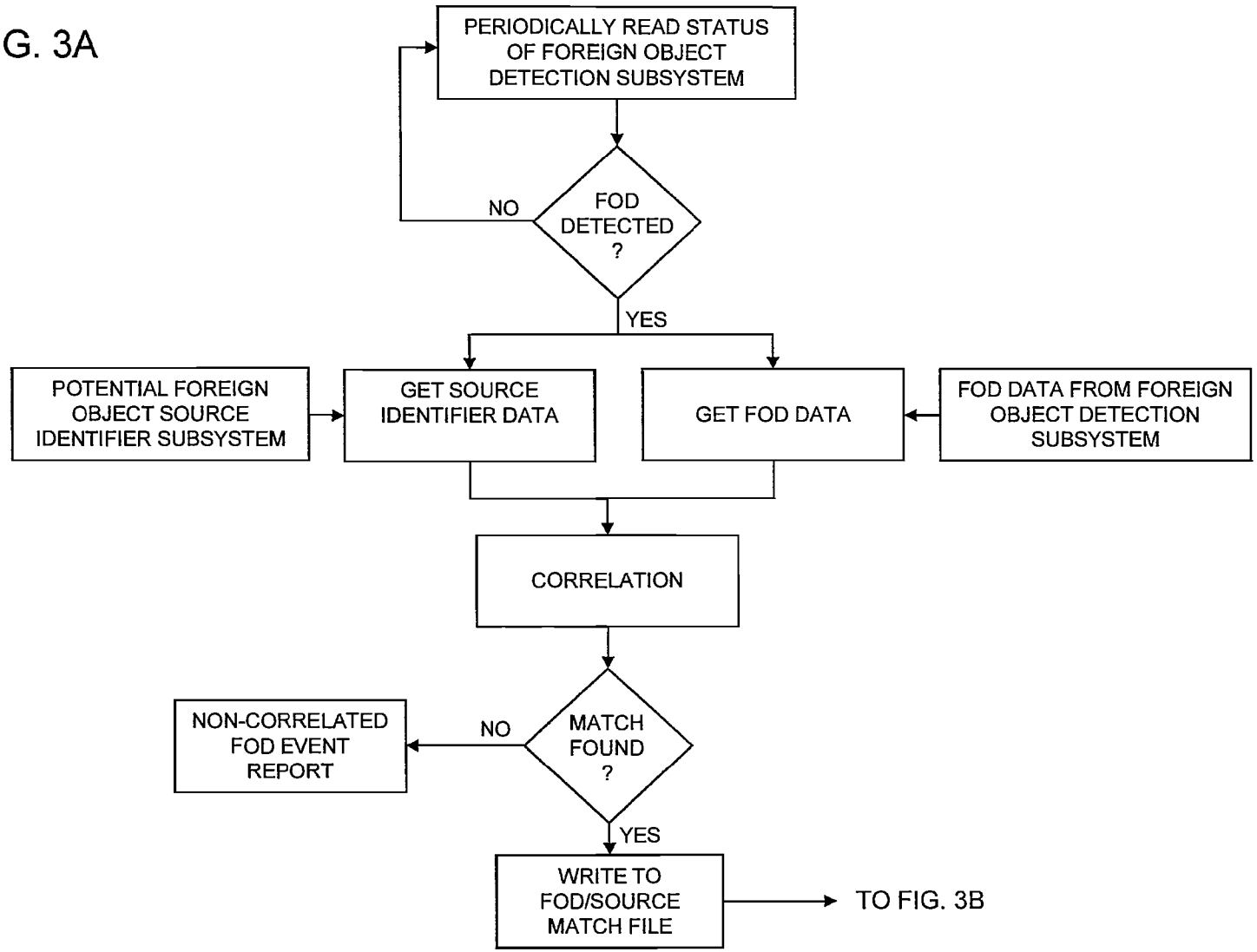
FIGS. 3A and 3B are together a simplified general flowchart of a method for detection of foreign objects on an aircraft travel surface and ascription of the foreign objects to foreign object sources present on the aircraft travel surface in accordance with a preferred embodiment of the present invention.
Figure 3B:
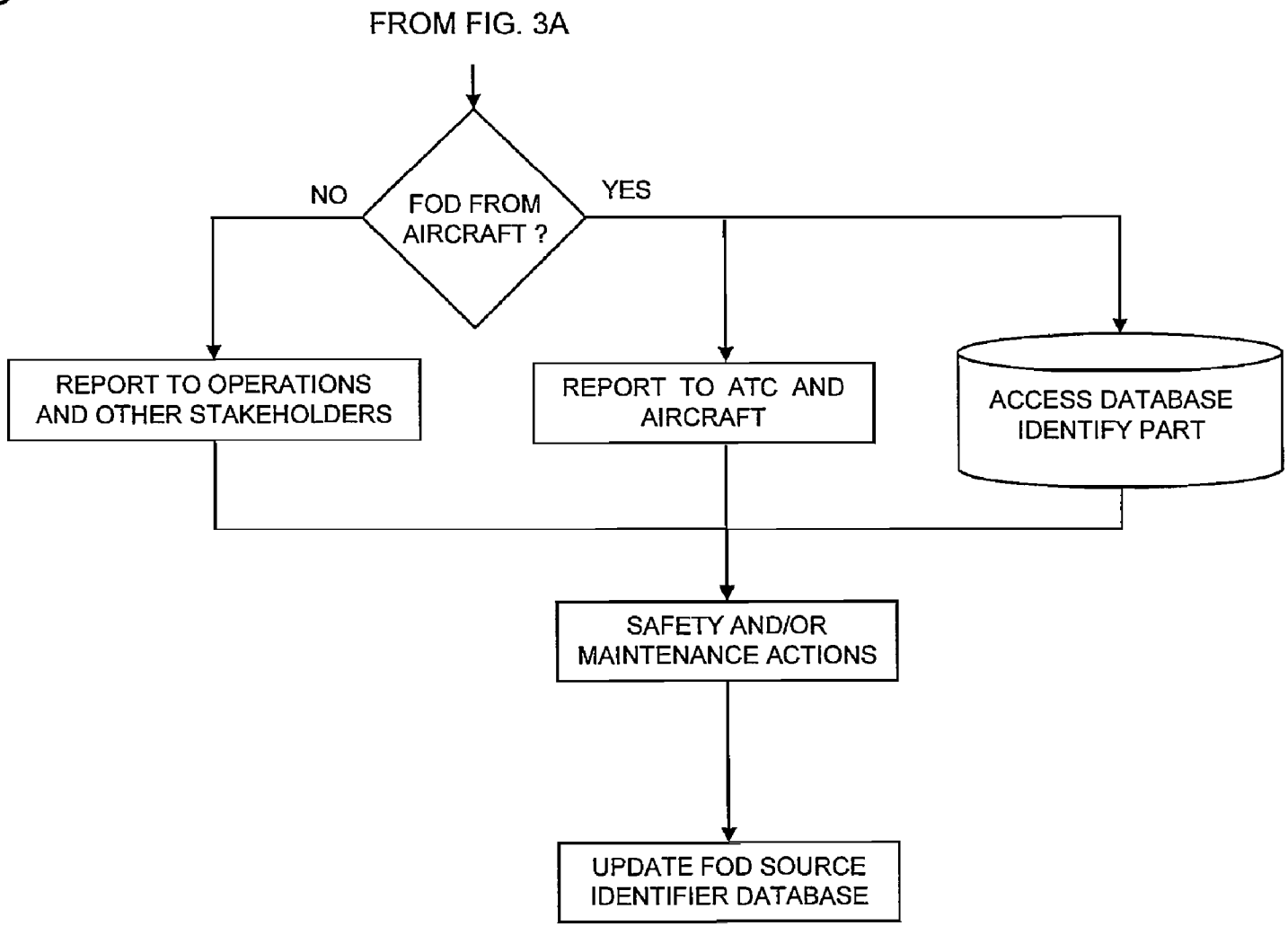

Reference is now made to FIGS. 3A and 3B, which are together a simplified general flowchart of a method for detection of foreign objects on an aircraft travel surface and ascription of the foreign objects to foreign object sources present on the aircraft travel surface in accordance with a preferred embodiment of the present invention.

As seen in FIG. 3A, the status of the foreign object detection subsystem is periodically monitored. If FOD is detected, the available data regarding the FOD and potential source identification data are obtained, respectively from the foreign object detection subsystem including server 112 (FIG. 1) and from the potential foreign object source identifier subsystem including server 124 (FIG. 1). Correlator 130 (FIG. 1) correlates this data and provides an ascription output indication of whether a source of the detected FOD has been identified. If no source is identified, a non-correlated FOD event report is generated.

As seen in FIG. 3B, if the source ascribed to the detected FOD is an aircraft, a report is immediately sent to air traffic control (ATC) and to the aircraft, and a suitable database is accessed to identify the detected FOD as a specific part of the aircraft, based on all known properties of the detected FOD, such as geometry, materials and color. Suitable safety and/or maintenance actions are immediately taken. If the source ascribed to the detected FOD is not an aircraft, a report is sent to aircraft operations and to the appropriate stakeholders, such as operators of ground vehicles. Suitable safety and maintenance actions are taken. A FOD source identifier database is preferably updated accordingly.

Figure 4:
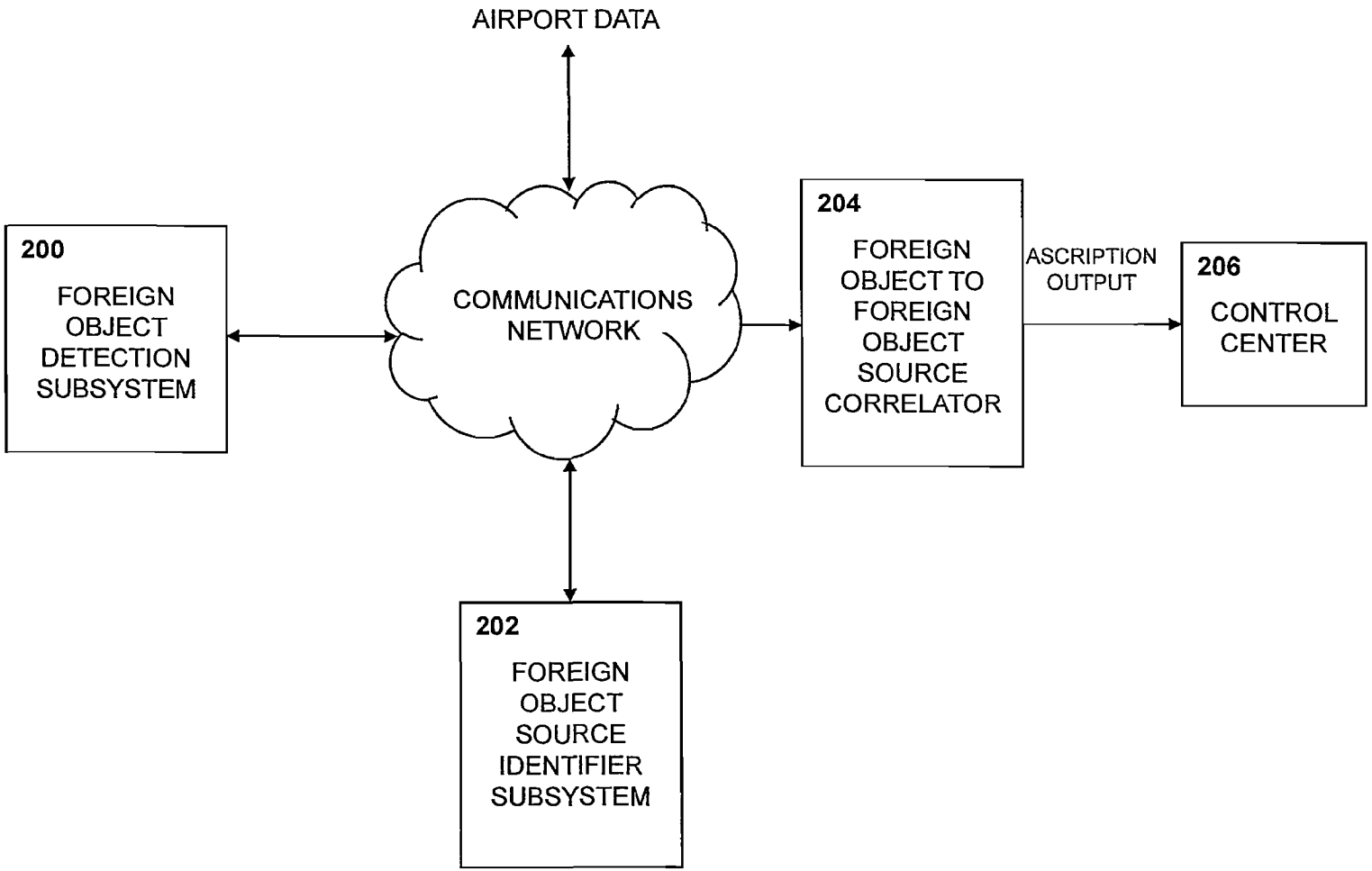
FIG. 4 is a simplified functional block diagram illustration of the system for detection of foreign objects on an aircraft travel surface and ascription of the foreign objects to foreign object sources present on the aircraft travel surface, illustrated in FIG. 1.

Reference is now made to FIG. 4, which is a simplified functional block diagram illustration of a preferred embodiment of the system for detection of foreign objects on an aircraft travel surface and ascription of the foreign objects to foreign object sources present on the aircraft travel surface, illustrated in FIG. 1. It is seen that the foreign object detection subsystem, here designated by reference numeral 200, and the potential foreign object source identifier subsystem, here designated by reference numeral 202, communicate with airport data sources and with a correlator, here designated by reference numeral 204. The ascription output of correlator 204 indicating a relationship between detected FOD and a source thereof is supplied to a control center, here designated by reference numeral 206, which may be located in an airport control tower or in any other suitable facility at any suitable location.

Figure 5:
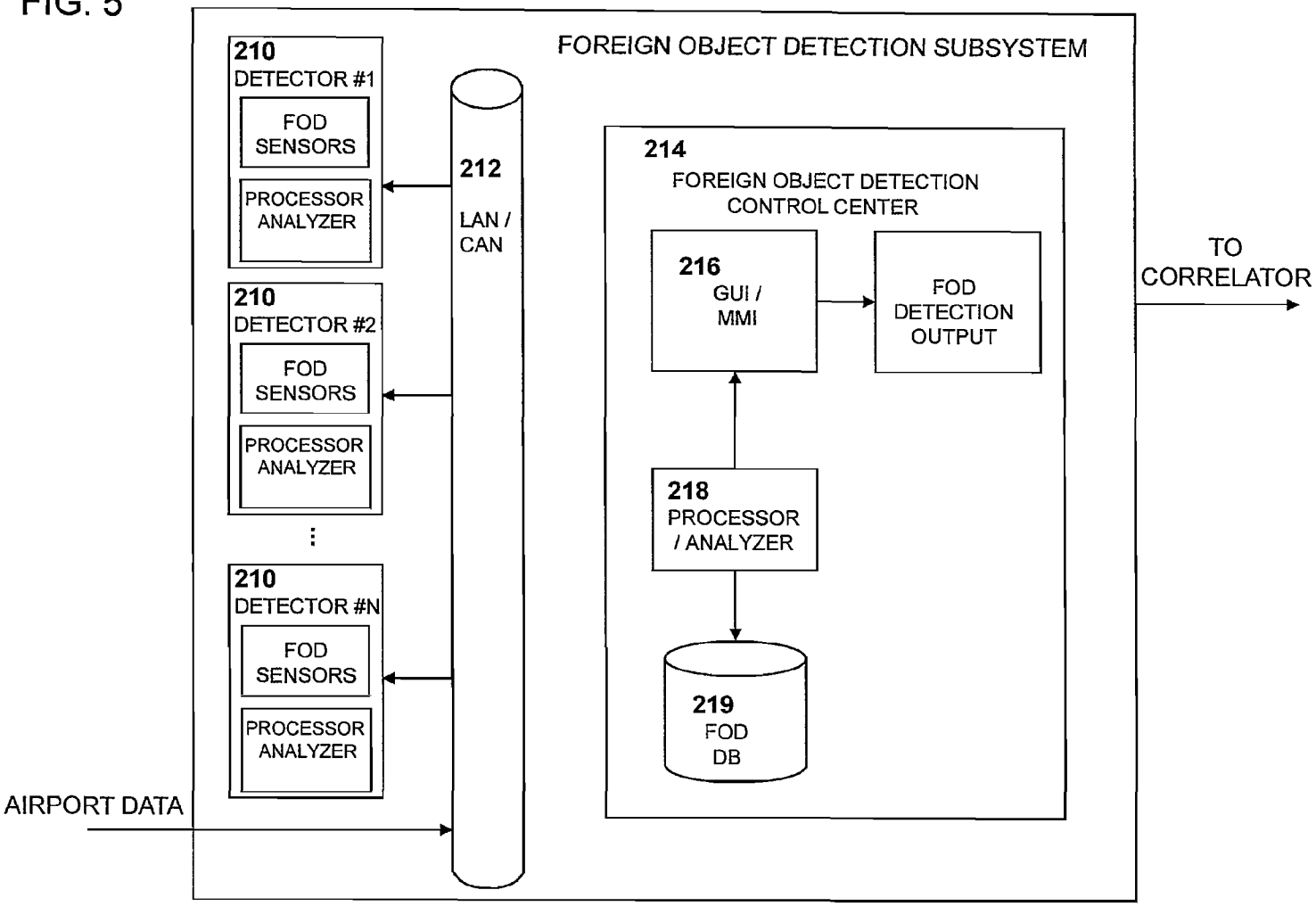
FIG. 5 is a simplified functional block diagram illustration of a foreign object detection subsystem operative to detect foreign objects on an aircraft travel surface, forming part of the system of FIGS. 1 and 4.

Reference is now made to FIG. 5, which is a simplified functional block diagram illustration of a foreign object detection subsystem operative to detect foreign objects on an aircraft travel surface forming part of the system of FIGS. 1 and 4 and constructed and operative in accordance with a preferred embodiment of the present invention.

As seen in FIG. 5, a plurality of FOD detector assemblies 210, such as FOD detectors 110 (FIG. 1) or combined foreign object and potential foreign object source detectors 122 (FIG. 1), each including one or more FOD sensors and associated processors and analyzers, may be networked together in a network 212, such as a Local Area Network (LAN) or Controller Area Network (CAN), which may also access airport data relating, inter alia, to aircraft movements, weather and visibility. A foreign object detection control center 214 communicates via network 212 with assemblies 210 and preferably includes an interface, such as a graphical user interface/man-machine interface (GUI/MMI) 216, which receives inputs from a combined processor/analyzer 218, which in turn communicates with a FOD detection database 219. GUI/MMI 216 provides suitable FOD detection outputs to the correlator 130 (FIG. 1) also identified by reference numeral 204 (FIG. 4).

Figure 6:
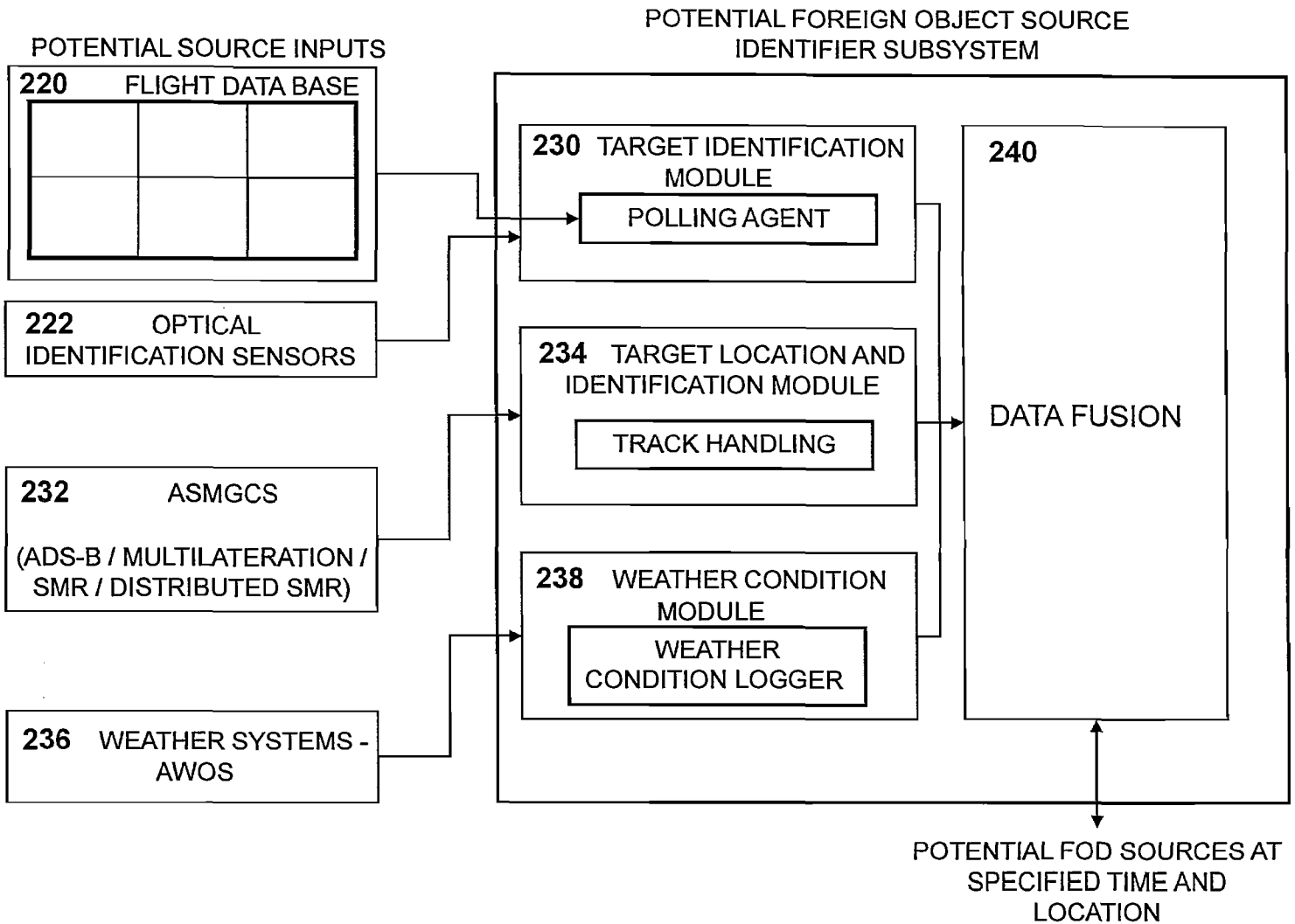
FIG. 6 is a simplified functional block diagram illustration of a potential foreign object source identifier subsystem operative to indicate the presence of potential foreign object sources at or near the aircraft travel surface at given times, forming part of the system of FIGS. 1 and 4.

Reference is now made to FIG. 6, which is a simplified functional block diagram illustration of a potential foreign object source identifier subsystem operative to indicate the presence of potential foreign object sources at or near the aircraft travel surface at given times, forming part of the system of FIGS. 1 and 4, constructed and operative in accordance with a preferred embodiment of the present invention.

The subsystem of FIG. 6 receives inputs from a plurality of indicators preferably including some or all of the following:

1.) A Flight Data Base 220 such as AMOSS, commercially available from F. S. Walker Hughes, Inc. of Denver, Colo., USA. Data base 220 contains numerous data fields regarding arrivals and departures of aircraft. The Flight Data Base 220 contains a shared view which can be accessed by a remote system.

2.) Optical Identification Sensors, here designated by reference numeral 222, such as OIS commercially available from Transtech Ltd. of Herzlia, Israel. Sensors 222 typically provides a data output on a periodic basis.

Data base 220 and sensors 222 preferably supply data to a Target Identification Module 230, which performs target tagging.

3.) An Advanced Surface Movement Guidance and Control System (ASMGCS) 232, commercially available from various companies, such as Thales of France, and employing sensing methods including Automatic Dependant Surveillance—Broadcast (ADS-B)/Multilateration, Surface Movement Radar (SMR) and Distributed SMR. ADS-B functionality is commercially available from Era of the Czech Republic and is based on multi-directional communication between multiple base stations located at an airport and a transponder installed on a target, such as an aircraft, ground vehicle, or airport machinery. SMR is commercially available from Raytheon and operates at X-Band frequencies. A distributed SMR system is commercially available from Transtech Ltd. of Herzliya, Israel and includes several Millimeter Wave Radars installed in key locations within an area of coverage.

ASMGCS 232 provides a potential source input to a Target Location and Identification Module 234 with sensed target travel pathways.

4.) A Weather Reporting System 236 such as AWOS 900 commercially available from AWI Inc. of Sacramento, Calif., USA. This system feeds weather data to a Weather Condition Module 238 which is responsible for logging weather conditions such as, Wind Speed, Wind Gusts, Wind Direction, Temperature and Visibility.

Data fusion functionality 240 receives inputs from modules 230, 234 and 238 and provides information regarding potential FOD sources at specified times and locations.

Figure 7:
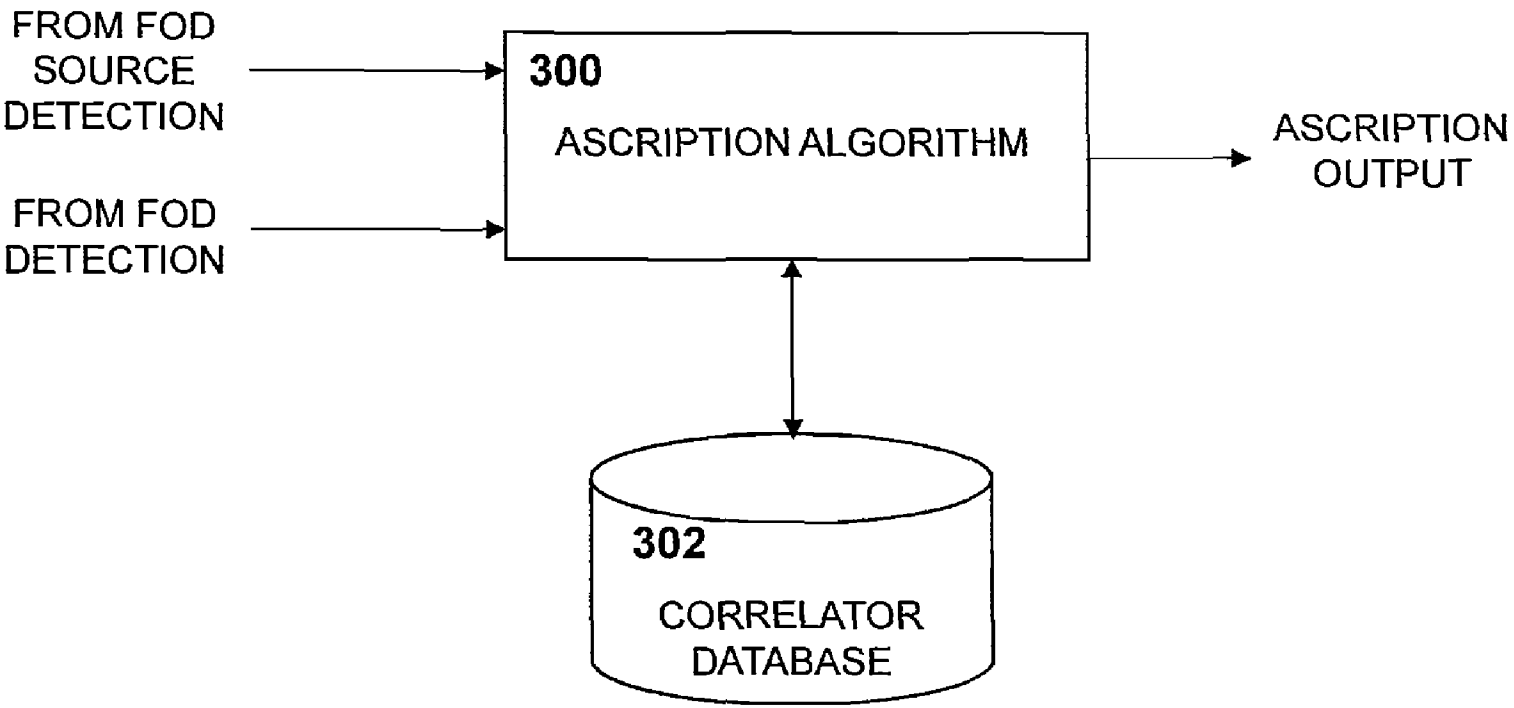
FIG. 7 is a simplified functional block diagram illustration of a foreign object to foreign object source correlator, forming part of the system of FIGS. 1 and 4.

Reference is now made to FIG. 7, which is a simplified functional block diagram illustration of a foreign object to foreign object source correlator such as correlator 130 (FIG. 1) or correlator 204 (FIG. 4), forming part of the system of FIGS. 1 and 4. It is seen that data from FOD detection and from potential FOD source identification is supplied to an ascription algorithm, here designated by reference numeral 300, which also preferably interfaces with a correlator database 302 and provides an ascription output, linking detected FOD with an identified FOD source.

Figure 8:
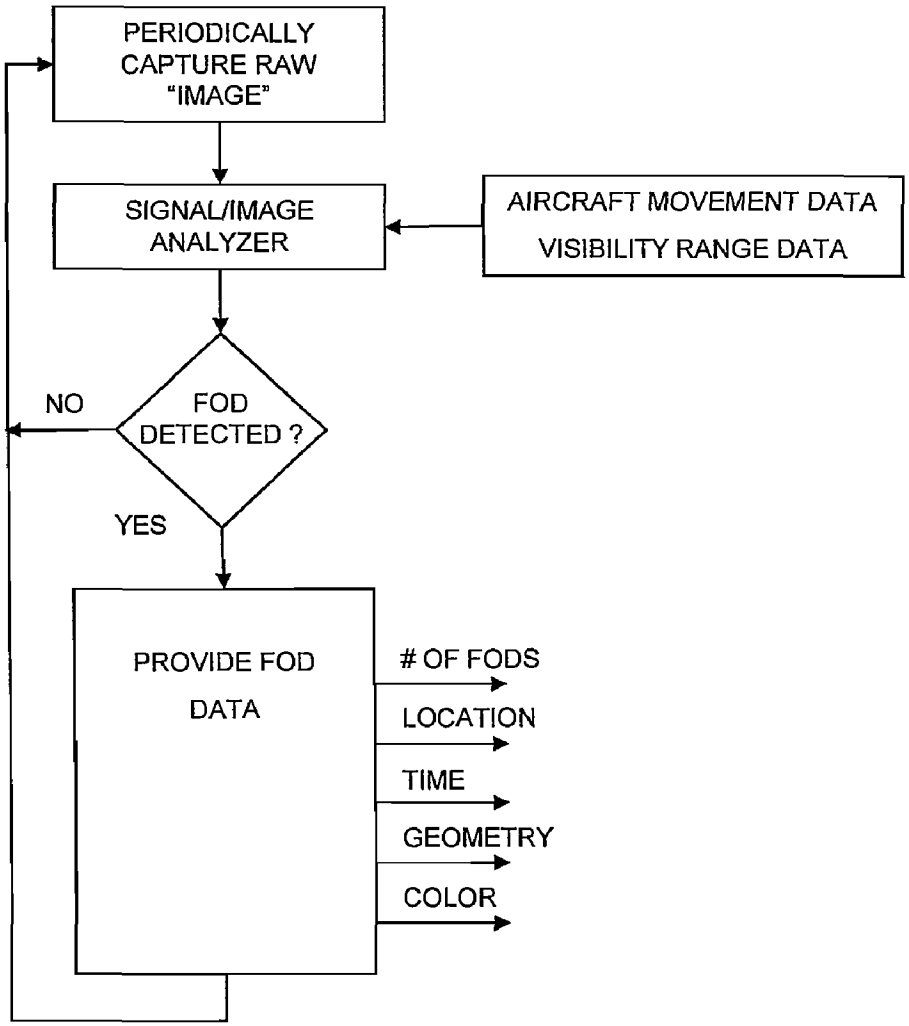
FIG. 8 is a simplified flow chart illustration of foreign object detection functionality operative to detect foreign objects on an aircraft travel surface, forming part of the method of FIGS. 3A & 3B.

Reference is now made to FIG. 8, which is a simplified flow chart illustration of foreign object detection functionality operative to detect foreign objects on an aircraft travel surface, forming part of the method of FIGS. 3A & 3B. As seen in FIG. 8, raw images of a monitored field of view are periodically acquired and analyzed, preferably employing aircraft movement data and visibility range data from external sources. If FOD is detected, one or more and preferably all of the following information is provided:

Number of FOD items detected;
Location of each detected FOD item;
Time of detection of each FOD item;
Geometry of each detected FOD item; and
Color of each detected FOD item.

Preferably suitable sensors are provided for additionally indicating the type of material which constitutes the detected FOD item.

Figure 9:
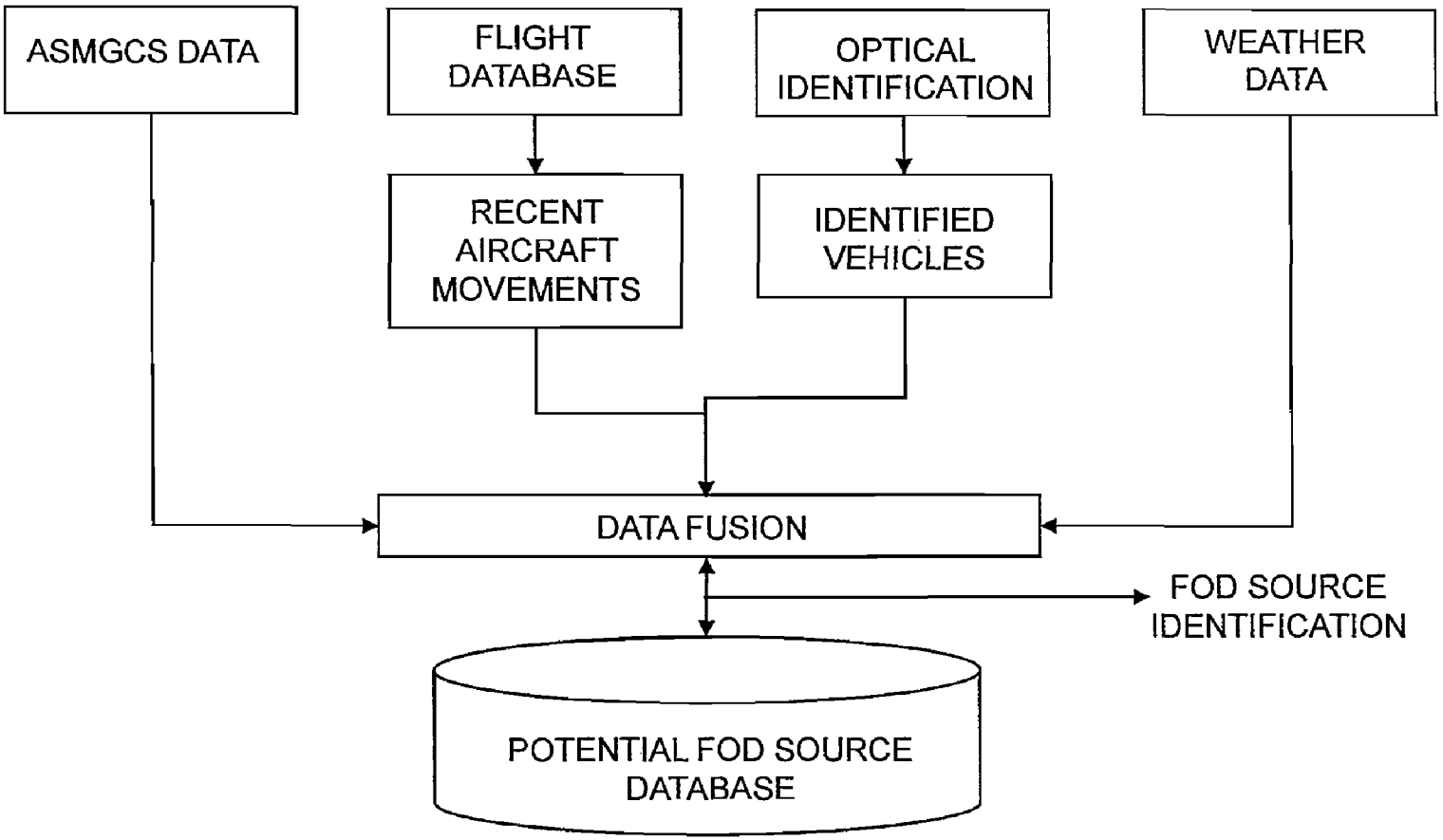
FIG. 9 is a simplified flow chart illustration of potential foreign object source identifier functionality operative to indicate the presence of potential foreign object sources at or near the aircraft travel surface at given times, forming part of the method of FIGS. 3A & 3B.

Reference is now made to FIG. 9, which is a simplified flow chart illustration of potential foreign object source identifier functionality preferably provided by the apparatus of FIG. 6 to indicate the presence of potential foreign object sources at or near the aircraft travel surface at given times and forming part of the method of FIGS. 3A & 3B.

As seen in FIG. 9, flight database data indicating recent aircraft movements and optical identification data indicating vehicle movements is supplied to data fusion functionality which also receives ASMGCS data and weather data and interfaces with potential FOD source identifier database functionality and provides FOD source identification.

Figure 10:
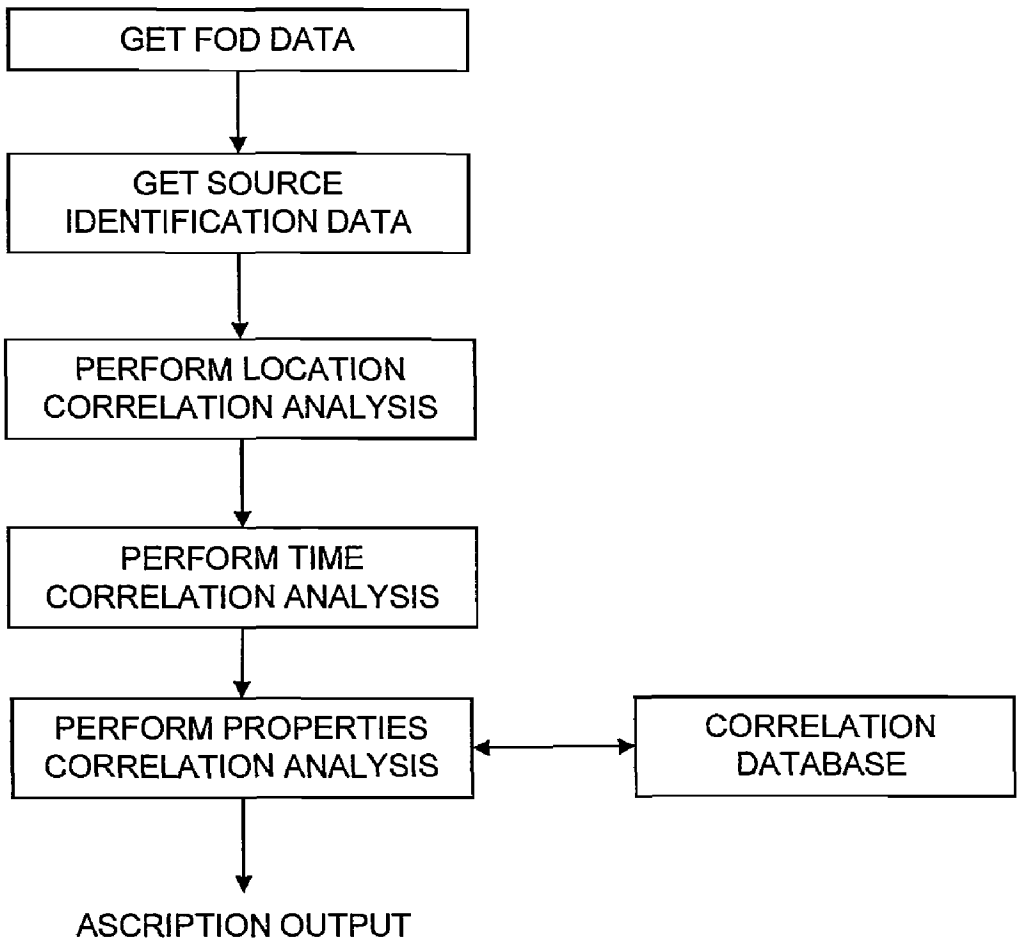
FIG. 10 is a simplified flow chart illustration of foreign object to foreign object source correlation functionality, forming part of the method of FIGS. 3A & 3B.

Reference is now made to FIG. 10, which is a simplified flow chart illustration of foreign object to foreign object source correlation functionality, forming part of the method of FIGS. 3A & 3B. As seen in FIG. 10, detected FOD data is acquired, following which relevant possible FOD source identification data is acquired. Location, time and FOD properties (e.g. materials, geometry and color) correlation analyses are preferably performed, preferably employing correlation database functionality which takes into account, inter alia, experience of the system in past ascriptions of sources to detected FOD.

It will be appreciated by persons skilled in the art that the present invention is not limited by what has been particularly described hereinabove. The scope of the present invention includes both combinations and subcombinations of various features described and illustrated hereinabove as well as modifications and variations thereof which would occur to persons skilled in the art upon reading the foregoing description and which are not in the prior art.

The invention claimed is:

1. A system for detection of foreign objects on an aircraft travel surface and ascription of the foreign objects present on the aircraft travel surface to foreign object sources, the system comprising:

a foreign object detection subsystem operative to detect foreign objects on an aircraft travel surface;

a potential foreign object source identifier subsystem operative to indicate the presence of potential foreign object sources at or near the aircraft travel surface; and a foreign object to foreign object source correlator operative to receive inputs from said foreign object detection subsystem and from said foreign object source identifier subsystem indicating at least a time relationship between sensed presence of said potential foreign object sources on the aircraft travel surface and detection of said foreign objects and to provide an ascription output indicating the origin of at least some of said foreign objects detected by said foreign object detection subsystem.

2. A system for detection of foreign objects on an aircraft travel surface and ascription of the foreign objects to foreign object sources according to claim 1 and wherein said foreign object to foreign object source correlator is operative to provide said ascription output indicating the origin of a foreign object detected by said foreign object detection subsystem within one minute of detection of said foreign object by said foreign object detection subsystem.

3. A system for detection of foreign objects on an aircraft travel surface and ascription of the foreign objects to foreign object sources according to claim 1 and wherein said foreign object to foreign object source correlator is operative to provide said ascription output indicating the origin of a foreign object, detected by said foreign object detection subsystem, within one minute of presence of said foreign object.

4. A system for detection of foreign objects on an aircraft travel surface and ascription of the foreign objects to foreign object sources according to claim 1 and wherein said potential foreign object source identifier subsystem comprises an optical identification system.

5. A system for detection of foreign objects on an aircraft travel surface and ascription of the foreign objects to foreign object sources according to claim 1 and wherein said potential foreign object source identifier subsystem comprises a cooperative sensing subsystem for receiving identification data from potential foreign object sources.

6. A system for detection of foreign objects on an aircraft travel surface and ascription of the foreign objects to foreign object sources according to claim 1 and wherein said potential foreign object source identifier subsystem comprises ADS-B/Multilateration functionality for receiving identification data from potential foreign object sources.

7. A system for detection of foreign objects on an aircraft travel surface and ascription of the foreign objects to foreign object sources according to claim 1 and wherein said potential foreign object source identifier subsystem comprises a flight database.

8. A system for detection of foreign objects on an aircraft travel surface and ascription of the foreign objects to foreign object sources according to claim 1 and wherein said potential foreign object source identifier subsystem comprises radar functionality for detecting potential foreign object sources.

9. A system for detection of foreign objects on an aircraft travel surface and ascription of the foreign objects to foreign object sources according to claim 1 and wherein said potential foreign object source identifier subsystem comprises an integrated system employing multiple identification functionalities.

10. A system for detection of foreign objects on an aircraft travel surface and ascription of the foreign objects to foreign object sources according to claim 1 and wherein said foreign object to foreign object source correlator is operative to receive inputs from said foreign object detection subsystem and from said foreign object source identifier subsystem indicating a time relationship between sensed presence of said potential foreign object sources on the aircraft travel surface and detection of said foreign objects and to provide, based on said time relationship, said ascription output indicating the origin of at least some of said foreign objects detected by said foreign object detection subsystem.

11. A system for detection of foreign objects on an aircraft travel surface and ascription of the foreign objects to foreign object sources according to claim 1 and wherein said foreign object to foreign object source correlator is operative in real time.

12. A system for detection of foreign objects on an aircraft travel surface and ascription of the foreign objects to foreign object sources according to claim 1 and wherein said foreign object detection subsystem and said potential foreign object source identifier subsystem are directed to at least partially different regions of said aircraft travel surface.

13. A system for detection of foreign objects on an aircraft travel surface and ascription of the foreign objects to foreign object sources according to claim 1 and wherein said foreign object detection subsystem comprises foreign object material identification functionality including remote spectrometry functionality.

14. A system for detection of foreign objects on an aircraft travel surface and ascription of the foreign objects to foreign object sources according to claim 1 and also comprising decision functionality operative to automatically provide a notification to said origin of said at least some of said foreign objects based on said ascription output.

15. A system for detection of foreign objects on an aircraft travel surface and ascription of the foreign objects to foreign object sources according to claim 1 and also comprising a foreign object source identifier database for storing said ascription output.

16. A method for detection of foreign objects on an aircraft travel surface and ascription of the foreign objects to foreign object sources, the method comprising:

detecting foreign objects on an aircraft travel surface;

indicating the presence of potential foreign object sources at or near the aircraft travel surface at given times; and receiving inputs indicating a time relationship between sensed presence of said potential foreign object sources on the aircraft travel surface and detection of said foreign objects and providing an ascription output indicating the origin of at least some of said foreign objects.

17. A method for detection of foreign objects on an aircraft travel surface and ascription of the foreign objects to foreign object sources according to claim 16 and wherein said ascription output indicating the origin of a foreign object is provided within one minute of detection of said foreign object on said aircraft travel surface.

18. A method for detection of foreign objects on an aircraft travel surface and ascription of the foreign objects to foreign object sources according to claim 16 and wherein said ascription output indicating the origin of a foreign object is provided within one minute of presence of said foreign object on said aircraft travel surface.

19. A method for detection of foreign objects on an aircraft travel surface and ascription of the foreign objects to foreign object sources according to claim 16 and also comprising automatically providing a notification to said origin of said at least some of said foreign objects based on said ascription output.

20. A method for detection of foreign objects on an aircraft travel surface and ascription of the foreign objects to foreign object sources according to claim 16 and also comprising storing said ascription output in a foreign object source identifier database.

* * * * *